US009770732B2

(12) United States Patent
Crawford

(10) Patent No.: US 9,770,732 B2
(45) Date of Patent: Sep. 26, 2017

(54) PORTABLE SPRAY SYSTEM

(71) Applicant: OutSol, LLC, Carlsbad, CA (US)

(72) Inventor: Christopher Jackson Crawford, Carlsbad, CA (US)

( * ) Notice: Subject to any disclaimer, the term of this patent is extended or adjusted under 35 U.S.C. 154(b) by 0 days.

(21) Appl. No.: 15/236,194

(22) Filed: Aug. 12, 2016

(65) Prior Publication Data

US 2016/0346803 A1 Dec. 1, 2016

Related U.S. Application Data

(63) Continuation-in-part of application No. 14/204,322, filed on Mar. 11, 2014, now abandoned.

(60) Provisional application No. 61/776,635, filed on Mar. 11, 2013.

(51) Int. Cl.

| | |
|---|---|
| ***A62C 15/00*** | (2006.01) |
| ***B05B 9/08*** | (2006.01) |
| ***B05B 9/04*** | (2006.01) |
| ***A47K 3/28*** | (2006.01) |
| *B05B 9/00* | (2006.01) |
| *B05B 1/18* | (2006.01) |

(52) U.S. Cl.

CPC ..... *B05B 9/04* (2013.01); *A47K 3/285* (2013.01); *A47K 3/288* (2013.01); *B05B 9/0822* (2013.01); *B05B 1/18* (2013.01); *B05B 9/002* (2013.01)

(58) Field of Classification Search

CPC ..... B05B 9/04; B05B 9/0822; B05B 1/18; B05B 9/002; A47K 3/285; A47K 3/288

USPC ..... 239/1, 46, 152, 453, 154, 172, 722, 302, 239/337, 373

See application file for complete search history.

(56) References Cited

U.S. PATENT DOCUMENTS

| | | | | | |
|---|---|---|---|---|---|
| 4,782,982 | A * | 11/1988 | Ellison | B05B 9/0816 | 141/18 |
| 5,284,300 | A * | 2/1994 | Gries | B05B 9/0805 | 141/2 |
| 5,622,056 | A * | 4/1997 | Utter | B05B 9/0838 | 239/152 |
| 6,029,589 | A * | 2/2000 | Simpson | A01M 21/04 | 111/127 |
| 6,651,702 | B2 * | 11/2003 | Marino | F41B 9/0025 | 141/114 |

* cited by examiner

*Primary Examiner* — Justin Jonaitis
(74) *Attorney, Agent, or Firm* — Todd J. Langford; Greenspoon Marder LLP

(57) ABSTRACT

A portable, self-pressurizing sprayer or shower system includes a pressure container within a tank. Pressurized fluid, such as water from a residential water tap, is fluidly connected to the pressure container to fill and pressurize the system with the fluid. The sprayer system is then disconnected from the pressurized fluid source and transported to a remote location. A tube is then fluidly connected to the pressure container and the pressurized fluid is released through the tube to provide a portable sprayer system. A heating probe is provided that is removably secured to a second port in the pressure container. A fill kit is provided to fill the pressure container with a fluid, and then a pump is used to pressurize the system when a pressurized fluid source is unavailable.

20 Claims, 7 Drawing Sheets

PORTABLE SPRAY SYSTEM

CROSS REFERENCE TO RELATED APPLICATIONS

This application is a continuation-in-part of U.S. patent application Ser. No. 14/204,322 filed on Mar. 11, 2014, which in turn claims the benefit of U.S. Provisional Patent Application No. 61/776,635 filed on Mar. 11, 2013, the entireties of which are hereby incorporated by reference.

BACKGROUND OF THE INVENTION

Field of the Invention

This invention relates to the general field of portable spray systems, and more specifically toward a portable, self-pressurizing sprayer or shower system. The sprayer system includes a pressure container within a tank. Pressurized fluid, such as water from a residential water tap, is fluidly connected to the pressure container to fill and pressurize the system with the fluid. The sprayer system is then disconnected from the pressurized fluid source and transported to a remote location. A tube is then fluidly connected to the pressure container and the pressurized fluid is released through the tube to provide a portable sprayer system.

Many individuals enjoy travelling to remote locations that have no running water. At the same time, there is still a demand for washing various items, including the individual himself or herself. Washing in a stream or river can be dangerous and unhealthy should the stream or river be contaminated. Transporting water in containers overcomes the problem of contaminated water, but it can be difficult to dispense water from the containers. Pressurizing the water in a remote location, as taught by the prior art, has involved operating a pump (usually manually) or raising the container of water to a sufficient height to use gravity as a way of providing pressure.

Thus there has existed a long-felt need for a system and method to easily provide pressurized water to a remote location.

SUMMARY OF THE INVENTION

The current invention provides just such a solution by having a portable, self-pressurizing sprayer or shower system. The sprayer system includes a pressure container within a tank. Pressurized fluid, such as water from a residential water tap, is fluidly connected to the pressure container to fill and pressurize the system with the fluid. The sprayer system is then disconnected from the pressurized fluid source and transported to a remote location. A tube is then fluidly connected to the pressure container and the pressurized fluid is released through the tube to provide a portable sprayer system.

It is an object of the current disclosure to provide a system for transporting and dispensing a volume of fluid under pressure.

It is another object of the current disclosure to provide a method for spraying a fluid transported to a remote location.

It is a further object of this current disclosure to provide a system for transporting a pressurized fluid.

It is yet another object of this current disclosure to provide a portable self-pressurizing shower system.

It is an additional object of the current disclosure to provide a remotely filled and pressured spray system.

It is a further object of the current disclosure to provide a portable spray system that dispenses heated water.

A particular embodiment of the current disclosure is a spray system comprising a housing; a pressure container, where the pressure container is encased within the housing; a first port, where the first port provides access to the bottom of the pressure container; a hose, where a first end of the hose connected to the first port; a valve, where the valve is connected to a second end of the hose; a quick release port, where the quick release port is connected to the valve; and a second port, where the second port provides access to the top of the pressure container. The first port extends towards, but not all the way to, the bottom of the pressure container. The spray system further comprises a sprayer; where the sprayer is releasably connected to the quick release port. The second port comprises threading. The spray system further comprises a heater, where the heater comprises a base unit, a cable, and a heating probe, where the heating probe is electrically connected to the base unit via the cable, and where the heating probe comprises threading. The heating probe extends through the second port and the threading of the probe mates with the threading of the second port. The cable of the heater comprises a plug, where the plug is releasably connected to the heating probe, whereby the heating probe is detachable from the base unit and cable. The base unit comprises a battery. The base unit comprises a switch, whereby activating the switch activates the heater. The spray system further comprises a fill kit, where the fill kit comprises a main body and a hose, where the hose is connected to the main body, where the main body comprises a fill line, where the fill line indicates the maximum amount of fluid that should be dispensed into main body of the fill kit such that the same volume of fluid dispensed into the pressure container wilt not overfill the pressure container. The main body further comprises an opening and a closure, where the closure seals the opening.

Another embodiment of the current disclosure is a method of dispensing a fluid comprising the steps of connecting a spray system to a fluid source, where the spray system comprises a housing; a pressure container, where the pressure container is encased within the housing; a first port, where the first port provides access to the bottom of the pressure container; a hose, where a first end of the hose connected to the first port; a valve, where the valve is connected to a second end of the hose; a quick release port, where the quick release port is connected to the valve; and a second port, where the second port provides access to the top of the pressure container; filling the spray system with the fluid from the fluid source; disconnecting the spray system from the fluid source; transporting the spray system to a different location; and dispensing the fluid from the spray system. The step of connecting a spray system to a fluid source comprises connecting one end of a second hose to a residential water tap and the other end of the hose to the quick release port. The step of dispensing the fluid from the spray system comprises connecting a spraying nozzle to the quick release port. The method further comprises the steps of inserting a heating probe through the second port; connecting a base unit to the heating probe via a cable; and activating a switch on the base unit to activate the heating probe there by providing heat to a fluid held within the pressure container. The method further comprises the steps of filling a fill kit, where the fill kit comprises a main body and a hose, where the hose is connected to the main body, where the main body comprises a fill line, where the fill line indicates the maximum amount of fluid that should be dispensed into main body of the fill kit such that the same volume of fluid dispensed into the pressure container will not overfill the pressure container, where the fill kit is filled to its fill line; inserting the hose of the fill kit through the second port and allowing the fluid to flow therethrough. The method further comprises the steps of sealing the second port; attaching a pressure adapter to the quick release port; attaching a pump to the pressure adapter; and pumping air into the pressure container.

An additional embodiment of the current disclosure is a method of dispensing heated water comprising the steps of filling a fill kit with water, where the fill kit comprises a main body and a hose, where the hose is connected to the main body, where the main body comprises a fill line, where the fill kit is filled to its fill line; filling a spray system, where the spray system comprises a housing; a pressure container, where the pressure container is encased within the housing; a first port, where the first port provides access to the bottom of the pressure container; a hose, where a first end of the hose connected to the first port; a valve, where the valve is connected to a second end of the hose; a quick release port, where the quick release port is connected to the valve; and a second port, where the second port provides access to the top of the pressure container, where the spray system is filled by inserting the hose of the fill kit through the second port and allowing the fluid to flow therethrough; inserting a heating probe through the second port, where the heating probe seals the second port; attaching a pressure adapter to the quick release port; attaching a pump to the pressure adapter; pumping air into the pressure container; closing the valve; providing power to the heating probe, whereby heat is produced by the heating probe to heat up the water within the pressure container; connecting a spraying nozzle to the quick release port; opening the valve; and dispensing water through the spraying nozzle. The step of providing power to the heating probe comprises connecting a base unit to the heating probe and activating a switch on the base unit. The main body of the fill kit further comprises an opening and a closure, where the closure seals the opening.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
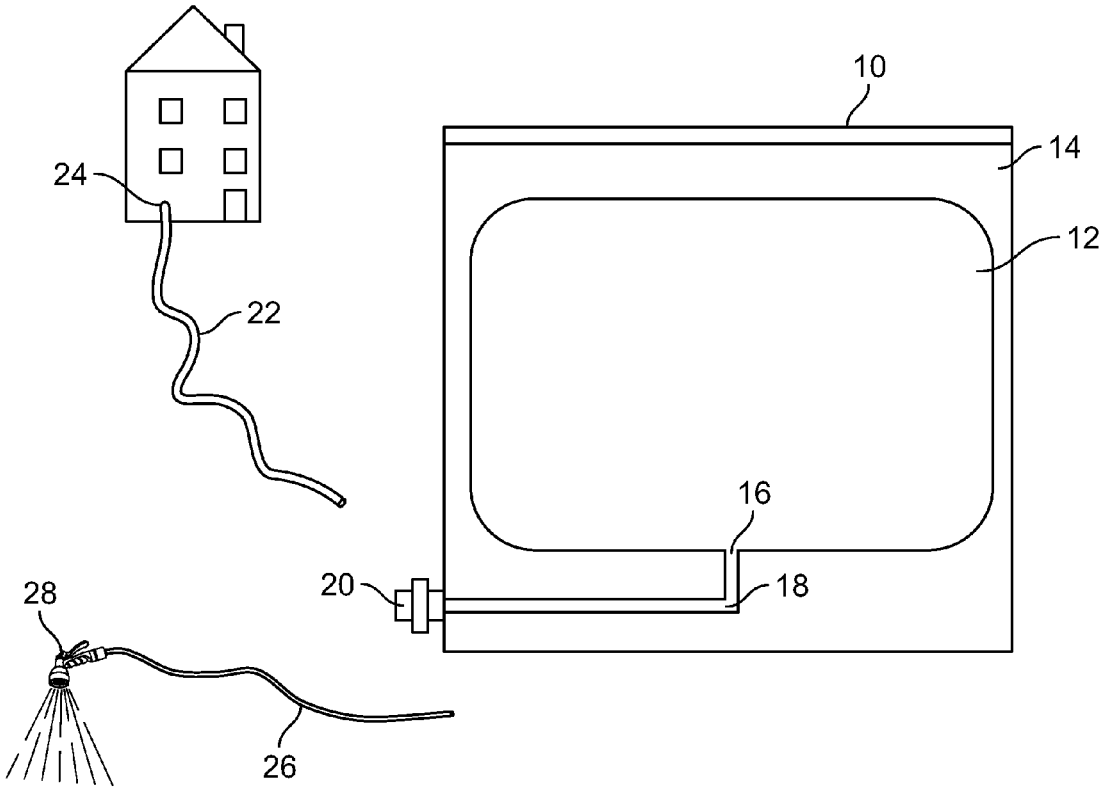
FIG. 1 is a cross-section side view of a portable, self-pressurizing spray system according to selected embodiments of the current disclosure.
Figure 2:
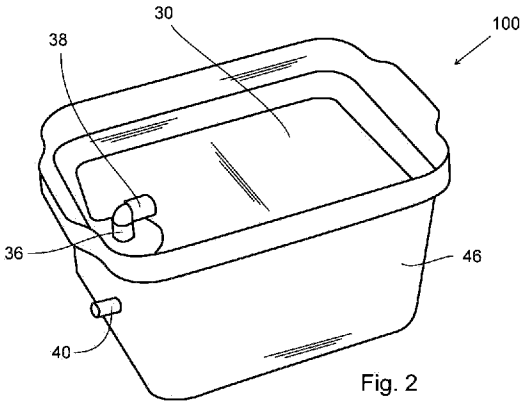
FIG. 2 is a top perspective view of a portable, self-pressurizing spray system according to selected embodiments of the current disclosure.
Figure 5:
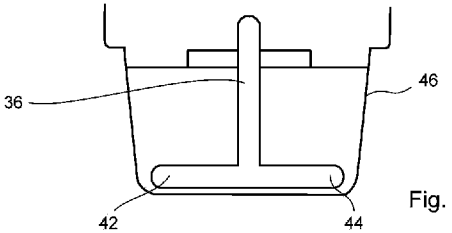
FIG. 5 is cross sectional view, taken along plane G-G of FIG. 3, of a portable, self-pressurizing spray system according to selected embodiments of the current disclosure.
Figure 7:
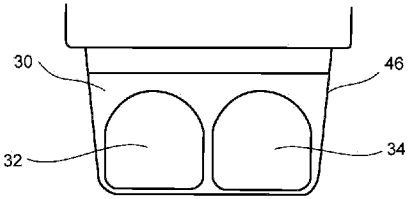
FIG. 7 is a cross sectional side view, taken along plane D-D of FIG. 6, of a portable, self-pressurizing spray system according to selected embodiments of the current disclosure.
Figure 4:
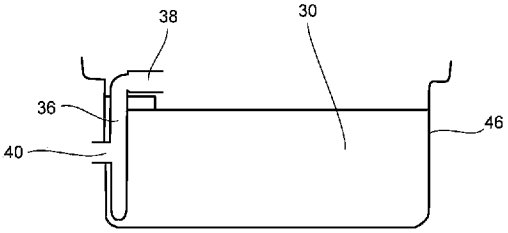
FIG. 4 is a cross sectional view, taken along plane E-E of FIG. 3, of a portable, self-pressurizing spray system according to selected embodiments of the current disclosure.
Figure 3:
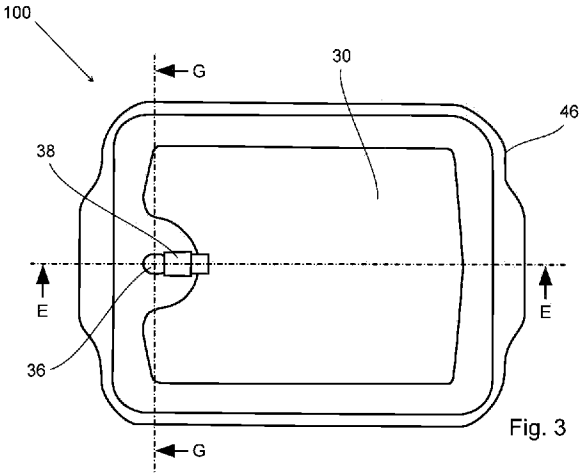
FIG. 3 is top view of a portable, self-pressurizing spray system according to selected embodiments of the current disclosure.
Figure 6:
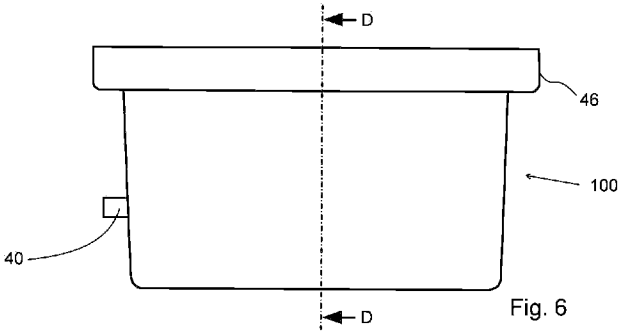
FIG. 6 is a side view of a portable, self-pressurizing spray system according to selected embodiments of the current disclosure.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 illustrates a portable, self-pressurizing sprayer system 10, or shower, according to a particular embodiment of the current disclosure. In this embodiment, the shower 10 comprises a tank 14 encasing a pressure container 12. A first end of a conduit 18 is attached to an opening 16 in the pressure container 12. A second end of the conduit 18 is disposed through an opening of tank 14 and is attached to a pressure container inlet/outlet coupler 20. Pressure container comprises an airtight seal, whereby the pressure container is airtight, except for the fluid connection to the conduit 18. Thus, when conduit 18 is sealed, the conduit and pressure container form a completely airtight container.

In various embodiments, tank 14 and pressure container 12 can be different shapes and sizes. For example, tank 14 and pressure container 12 can be substantially round, oval, square, rectangular or other shape so long as pressure container 12 is substantially located within and supported by tank 14. In the embodiment shown in FIG. 1, tank 14 is substantially rectangular in shape with a height of approximately sixteen inches and a diameter of approximately nine inches. Likewise, pressure container 12 is substantially cylindrical in shape with a height of approximately fourteen inches and a diameter of approximately six inches.

Typically, conduit 18 is substantially tube-shaped to allow fluid to flow in and out of pressure container 12. In an embodiment, conduit 18 is approximately twelve inches in length and approximately one-half inches in diameter.

In various embodiments, tank 14, pressure container 12 and conduit 18 comprise any substantially rigid material such as plastic or metal. Generally, the rigid material(s) comprising pressure container 12 and conduit 18 must be able to withstand a pressure of at least approximately sixty to one-hundred pounds per square inch (60-100 psi). In various embodiments, tank 14, pressure container 12 and conduit 18 comprise plastic materials such as polyvinyl chloride (PVC) or polyethylene plastic. These types of materials are durable, washable and relatively easy to manufacture. The above dimensions and materials are examples, and it is recognized that these dimensions and materials can be modified depending upon such factors as amount of fluid that is desired for spraying. In a particular embodiment, the tank, pressure container, and conduit are made from rigid material(s).

The pressure container inlet/outlet coupler 20 allows fluid both to enter conduit 18 to fill pressure container and to exit conduit 18 for dispensing. Located on the exterior of the tank 14, pressure container inlet/outlet coupler 20 is capable of connecting to a first end of a first hose 22. A second end of first hose 22 can be connected to any source of fluids that are used to fill the spray system 10. In an embodiment, pressure container inlet/outlet coupler 20 comprises a standard quick release fitting with a size of one-half inches, and a first hose 22 comprises a standard garden hose. In this embodiment, the second end of first hose 22 is connected to a standard residential water tap 24 to provide water to fill sprayer system 10. Pressure inlet/outlet coupler 20 is also capable of connecting to a first end of a second hose 26. In alternative embodiments, second hose 26 can be the same as first hose 22 in order to aid transportability and ease of use. A second end of second hose 26 comprises or is connected to a sprayer 28. In a particular embodiment, sprayer 8 comprises a standard trigger-handle spray nozzle.

For operation of the portable, self-pressurizing sprayer system 10, water is turned on at the residential water tap source and flows through first hose 22 to pressure inlet/outlet coupler 20. The water then flows through conduit 18 and begins to pressure container 12. Because pressure container 12 is sealed air-tight, ambient air located within pressure container 12 begins to compress as the water flows into pressure container 12. Once sprayer system 10 is filled with a desired amount of water, the user turns off the water tap source and disconnects the first end of first hose 22 from pressure inlet/outlet coupler 20. At this point, sprayer system 10 is transportable to any location for use, and the water held within pressure container 12 is now stored under pressure of approximately 60-100 psi, or that which was provided by the residential water tap source.

When the user decides the appropriate time and location to dispense the water, second hose 26 is attached to pressure inlet/outlet coupler 20. By initiation of sprayer 28, the stored-up pressure inside of pressure container 12 forces water to flow from pressure container 12 through conduit 18, pressure inlet/outlet coupler 20, hose 26 and to discharge through sprayer 28.

FIGS. 2 through 7 illustrate a portable, self-pressurizing spray system 100 in an alternative embodiment. In this embodiment, spray system 100 comprises a tank 46 encasing a pressure container system 30. Pressure container system 30 comprises a first pressure sub-container 32 and a second pressure sub-container 34. First pressure sub-container 32 and second pressure sub-container 34 are attached and fluidly connected to a conduit 36. Conduit 36 comprises a first pressure sub-container inlet/outlet 42, a second pressure sub-container inlet/outlet 44, a filling inlet 40 and a dispensing outlet 38. First pressure sub-container inlet/outlet 42 is attached to first pressure sub-container 32, and second pressure sub-container inlet/outlet 44 is attached to second pressure sub-container 34. Filling inlet 40 is disposed through an opening of tank 46. Pressure container system 30 comprises an air-tight seal.

In the embodiment shown in FIGS. 2-7, tank 46 and pressure container system 30 are substantially rectangular in shape and pressure container system 30 is substantially located within and supported by tank 46. In this embodiment, tank 46 has a length of approximately seventeen inches, a width of approximately fourteen inches, and a height of approximately twenty inches. First pressure sub-container 32 and second pressure sub-container 34 are substantially rectangular in shape, with lengths of approximately twelve inches, widths of approximately six inches, and heights of approximately eight inches.

Typically, conduit 36 is substantially tube-shaped to allow fluid to flow in and out of pressure container system 30. In an embodiment, conduit 36 is approximately four inches in length and one-half inches in diameter.

In various embodiments, tank 46, pressure container system 30 and conduit 36 comprise any substantially rigid material such as plastic or metal. Generally, the rigid material(s) comprising pressure container system 30 and conduit 36 must be able to withstand a pressure of at least approximately 60-100 psi. In various embodiments, tank 46 pressure container, system 30 and conduit 36 comprise plastic materials such as polyvinyl chloride (PVC) or polyethylene plastic. These types of materials are durable, washable and relatively easy to manufacture. The above dimensions and materials are examples, and it is recognized that these dimensions and materials can be modified depending upon such factors as amount of fluid that is desired for spraying.

The filling inlet 40 allows fluid to enter and flow through conduit 36 to fill pressure container system 30. Similarly, dispensing outlet 38 allows fluid to exit pressure container system 30 via conduit 36. On the exterior of tank 46, filling inlet 40 is capable of connecting to a first end of a first hose (such as hose 22 shown in FIG. 1). A second end of first hose can be connected to any source of fluids that are used to fill sprayer system 100. In one embodiment, filing inlet 40 comprises a standard quick release fitting with a size of one-half inches. In one embodiment, first hose is a standard garden hose. In this embodiment, the second end of first hose is connected to a standard residential water tap to provide water to fill sprayer system 100. In another embodiment, dispensing outlet 38 is also capable of connecting to a first end of a second hose (such as second hose 26 shown in FIG. 1). In various embodiments, the second hose can be the same hose as the first hose or a separate hose. A second end of second hose comprises or is connected to a sprayer. In an embodiment, sprayer comprises a standard trigger-handle spray nozzle.

For operation of the portable, self-pressurizing sprayer system 100, water is turned on at the residential water tap source and flows through first hose to filling inlet 40 and conduit 36. The water then flows through conduit 36 and begins to fill first pressure sub-container 32 and second pressure sub-container 34 in pressure container system 30. Because first pressure sub-container 32 and second pressure sub-container 34 are sealed air-tight, ambient air located within pressure container system 30 begins to compress as the water flows into pressure container system 30. Once sprayer system 100 is filled with a desired amount of water, the user turns off the water tap source and disconnects the first end of first hose from filling inlet 40. At this point, sprayer system 100 is transportable to any location for use, and the water held within pressure container 12 is now stored under pressure of approximately 60-100 psi, or that which was provided by the source of fluid.

When the user decides the appropriate time and location to dispense the water, a second hose (or the same hose as originally used) is attached to dispensing outlet 38. By initiation of a sprayer integrated with or attached to the second hose, the stored-up pressure inside of pressure container system 30 forces water to flow from first pressure sub-container 32 and second pressure sub-container 34 through conduit 36, dispensing outlet 38, second hose and to discharge through the sprayer.

Another embodiment provides for a portable shower system with a flexible, expandable bladder as a pressure container within the tank. There is an airtight chamber between the tank (external structure) and the pressure container, where the airtight chamber is filled with a gas (such as air) at an ambient pressure. The pressure container includes a port providing fluid access to the pressure container. When a fluid source (under pressure, such as a residential water tap) is connected to the pressure container, fluid fills the pressure container causing it to expand. As the pressure container fills with fluid and expands, the pressure in the airtight chamber between the tank and pressure container increases. Eventually, the pressure in the airtight chamber will equal that inside the pressure container. The fluid source is then disconnected from the pressure container, and the pressure container is sealed. The portable shower system is then transported to another location. A hose with a nozzle, or other dispensing tube, is fluidly connected to the pressure container. The pressure of the gas in the airtight chamber acts upon the pressure container. As the nozzle is opened, the pressurized fluid in the pressure container flows through the hose and out the nozzle. In this manner, a portable shower system may be utilized to spray a fluid in a remote location.

Further embodiments include multiple pressure containers of the same or differing shape. Those skilled in the an will appreciate that larger pressure containers or a greater number of pressure containers is required to hold and dispense larger volumes of fluid. At the same time, smaller pressure containers and fewer pressure containers will allow for an overall smaller spray system size that is lighter and easier to transport, and may be well suited for situations where a limited quantity of pressurized fluid is sufficient.

In yet another embodiment, the tank of the spray system has wheels attached thereto or incorporated therein. Wheels, for example, affixed to one end of the tank (one on each side) enable a user to lift one end of the spray system, and have the other end supported by the wheels. Another embodiment provides for a separate wheel system that attaches to and/or connects with the tank of the spray system. The tank rests on top of and may be secured to a platform, where wheels are secured to one end or both ends of the platform.

In a particular embodiment, the spray system further comprises a heater. Using the spray system as a shower, while sufficient with cold water, is preferable if warm water is dispensed. In one embodiment, heater coils are wrapped around the conduit such that fluid leaving the one or more pressure containers passes through the conduit where heat is transferred to the fluid before it is dispensed from the spray system. In another embodiment, a heat exchanger is integrated between the conduit and the one or more pressure containers and/or integrated within the conduit itself. Fluid (water) passes through the heat exchanger, is heated to a higher temperature, and then continues through the conduit, hose, and is sprayed through the nozzle.

A further embodiment of the current disclosure provides for one or more storage compartments within the spray system. The storage compartments allow for one or more hoses to be stored with the spray system, along with other items. For example, a standard garden hose along with a trigger-style spray nozzle may be transported with the spray system by using the storage compartments. Such an embodiment enables a user to store and transport important components of the current system and method.

The system and method disclosed herein provides for connecting the sprayer system to a fluid source, as well as connecting a hose to one or more pressure containers. During transitional processes, such as connecting and disconnecting hoses to the inlet and outlet ports, the pressure within the pressure containers may cause fluid to escape. To reduce and/or eliminate fluid escaping during connection and disconnection of hoses to inlet and outlet ports, valves may be positioned within or in fluid connection with the inlet and/or outlet ports. For example, a user connects the hose to inlet port, and then opens the valve. Fluid flows through hose, through the inlet port and conduit, and then into the pressure container. The valve is then closed and the hose removed. To dispense fluid, a hose is connected to a dispensing outlet port, and the valve is opened. Fluid is then dispensed through the hose, as regulated by any nozzle attached at the opposing end, if any. After use, the valve is closed. In this fashion, fluid may be filled into and dispensed from the spray system with little spillage.

Figure 8:
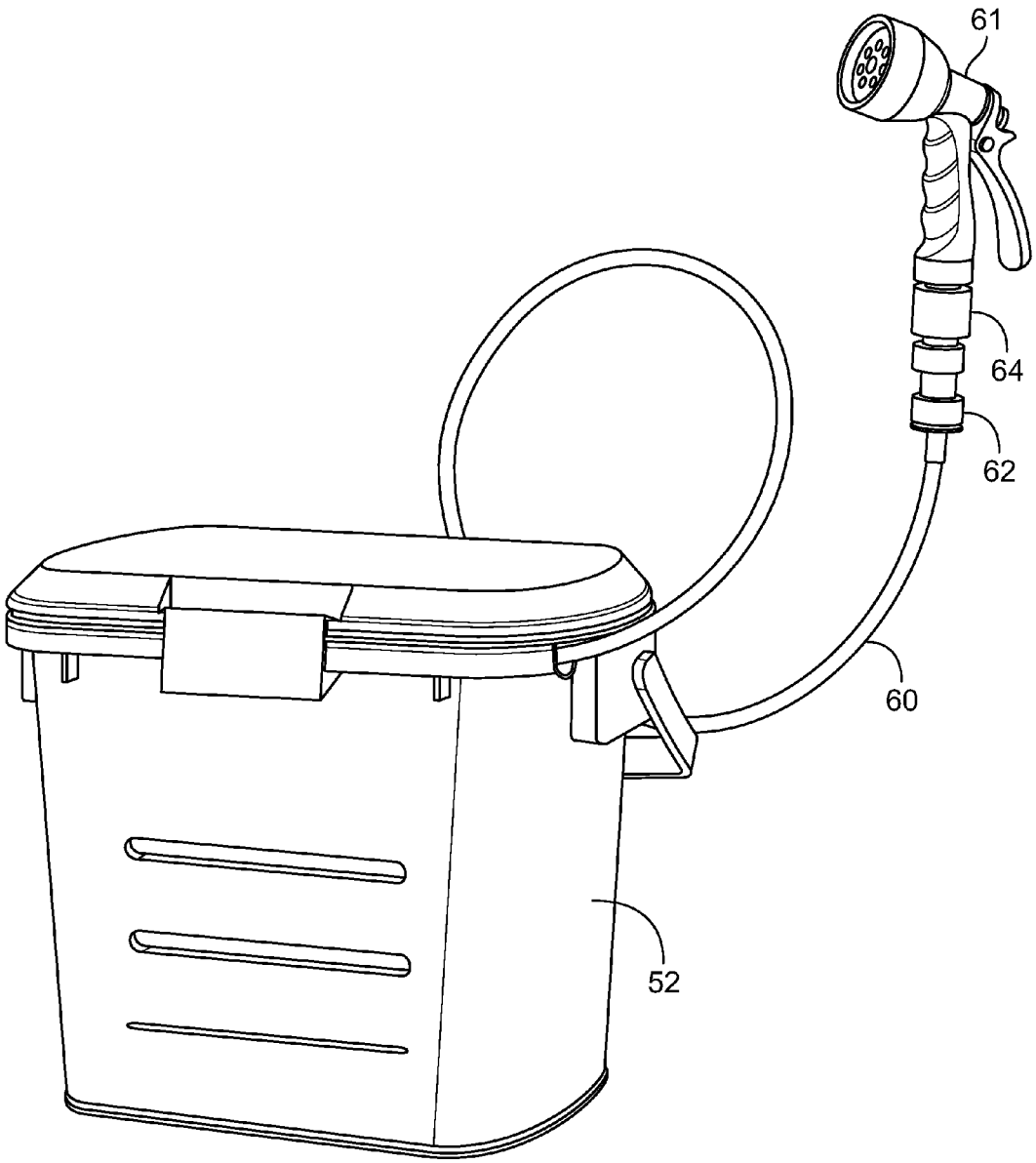
FIG. 8 is a perspective view of a portable, self-pressurizing spray system with a single pressure container according to selected embodiments of the current disclosure.

FIG. 8 is a perspective view of a portable, self-pressurizing spray system with a single pressure container according to selected embodiments of the current disclosure. The portable spray system includes a main body or tank 52, also referred to as a housing, from which extends a hose 60. The hose has a valve 62 at its end opposite of that from the tank 52. The valve 62 can be closed to restrict fluid access to the tank, or opened to provide fluid access to the tank 52. Attached to the valve 62 is a quick release adapter 64 that allows for the quick and secure fluid connection of various attachments. Once such attachment is a sprayer 61, which is a nozzle, and in a particular embodiment, a variable nozzle for spraying fluid stored under pressure within the tank 52.

Figure 9:
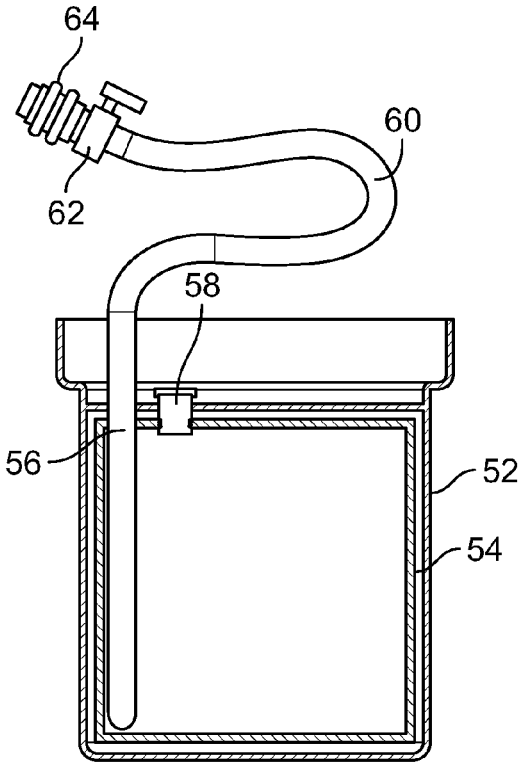
FIG. 9 is a cross-sectional side view of the portable spray system in FIG. 8, according to selected embodiments of the current disclosure.

FIG. 9 is a cross-sectional side view of the portable spray system in FIG. 8, according to selected embodiments of the current disclosure. The portable spray system has a pressure container 54 housed within the tank 52. Access to the pressure container 54 is provided through a first port 56 and a second port 58. The first port 56 is connected to a hose 60 and provides fluid access to the bottom of pressure container 54. The second port 58 provides fluid access to the top of the pressure container 54. The hose 60 is shown with a valve 62 and quick release adapter 64 secured to its end.

Figure 10:
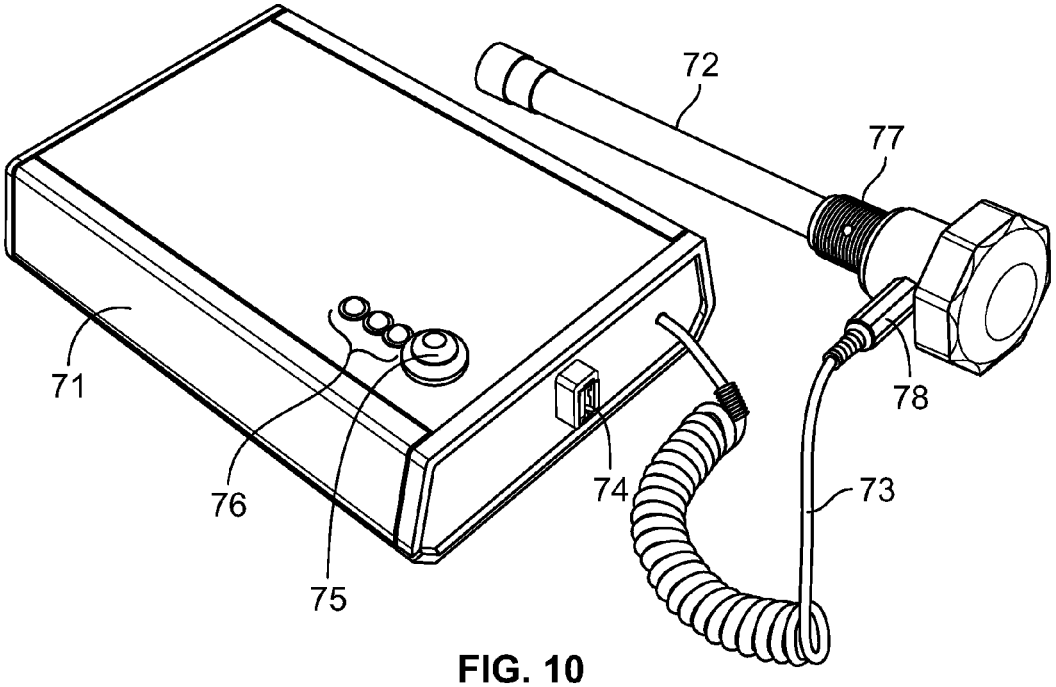
FIG. 10 is a perspective view of a portable heater for a portable spray system according to selected embodiments of the current disclosure.

FIG. 10 is a perspective view of a portable heater for a portable spray system according to selected embodiments of the current disclosure. The portable heater has a heating probe 72 connected to a base unit 71 via a cable 73. A plug 78 allows the cable 73 to be removably secured to the heating probe 72. Threading 77 on heating probe 72 allows the probe to mate with and create a fluid tight seal with the second port of the spray system, which itself includes a threaded opening. The base unit 71 houses a battery or batteries (not visible) which provides power to the heating probe 72 via cable 73 when switch 75 is activated. Indicator lights 76 show whether the portable heater is switched on, and if so, the relative remaining charge of the battery or batteries of the portable heater. A universal serial bus (USB) port 74 on the base unit 71 provides power to external devices connected via a USB cable (not shown). The batteries of the portable heater may be rechargeable, wherein the base unit further includes a port for connecting an external power adapter, whereby the batteries of the base unit may be charged. Alternatively, the batteries of the portable heater may be replaceable, where used batteries are discarded and new ones are inserted into the base unit of the portable heater.

Figure 11:
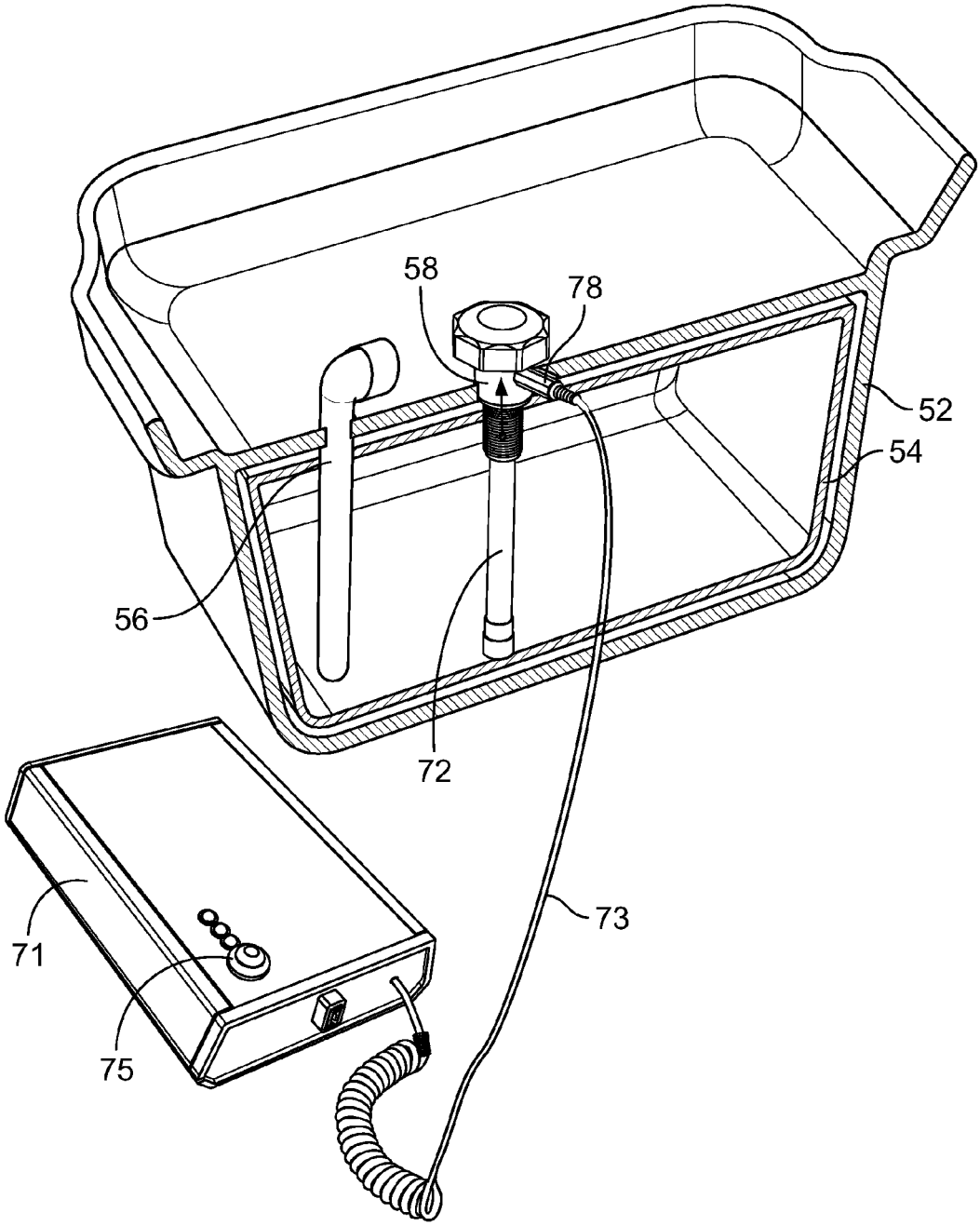
FIG. 11 is a cutaway side view of a portable heater mated with a portable spray system according to selected embodiments of the current disclosure.

FIG. 11 is a cutaway side view of a portable heater mated with a portable spray system according to selected embodiments of the current disclosure. To mate portable heater with the portable spray system, a port covering (not shown in this figure) that is used to seal the second port 58 is removed. The heating probe 72 of the portable heater is inserted through the second port 58 and screwed in place such that the threading 77 of the probe 72 mates with threading of the second port 58. This creates a fluid tight seal between the probe 72 and the pressure container 54 of the portable spray system. The pressure container 54 is then filled with a fluid, such as water, through the first port 56, either under pressure, as discussed above, or at ambient pressure and then pressurized using a fill kit, as discussed below. Alternatively, the pressure container 54 already has a fluid therein, and is pressurized after the heating probe 72 is mated in the second port 58. The heating probe 72 may be removed from the pressure container 54, most likely when the pressure container is not pressurized, by unscrewing and then removing the heating probe in direction of the indicating arrow.

To heat the fluid within the pressure container 54, the plug 78 of the cable 73 is mated with the heating probe 72, and the switch 75 on the base unit 71 is activated. In a particular embodiment, the switch 75 is a two-way button switch, whereby depressing and releasing a disabled switch activates the switch, and depressing and releasing an activated switch disables the switch. When the switch 75 is activated, power is provided to heating elements of the heating probe 72 thereby causing it to produce heat and increase the temperature of the fluid within the pressure container 54. Particular embodiments provide for a temperature sensor incorporated into or with the heating probe 7. The temperature sensor measures the temperature of the fluid surrounding the heating probe. Should the temperature sensed by the temperature sensor exceed a certain value, for example one-hundred degrees (100°) Fahrenheit, it shuts off the heating element of the heating probe to prevent overheating the fluid within the pressure container 54.

The portable spray system may be safely transported with the heating probe 72 of the heater mated with the second port. The plug 78 of the cable 73 is disconnected from the heating probe 72, and the heating probe 72 stays mated with the second port and acts as a port cover. After the portable spray system is transported to its destination, the plug 78 of the cable 73 is connected to the heating probe 72, and the switch 75 activated to heat the fluid within the pressure container 54.

Figure 12:
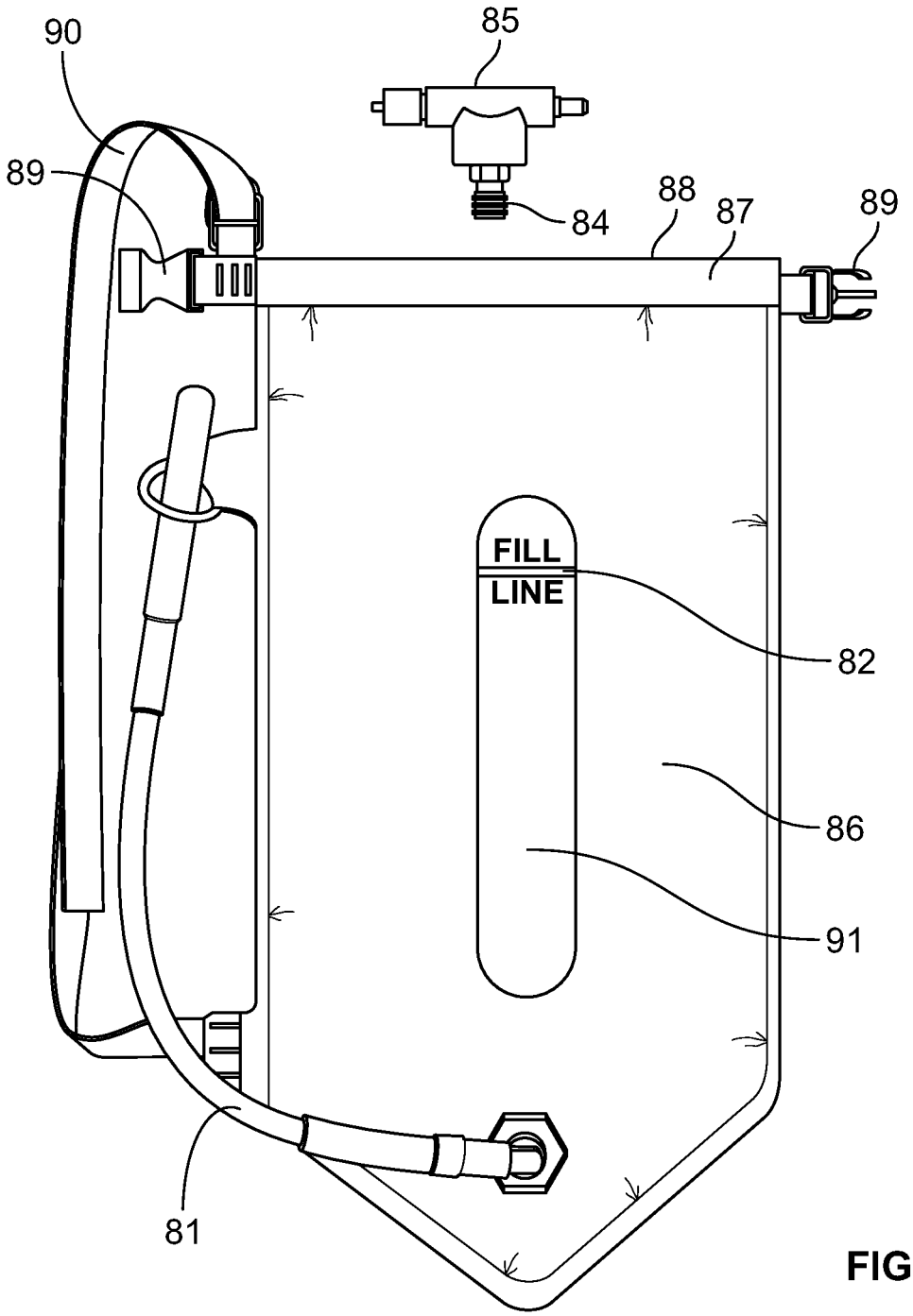
FIG. 12 is a front view of a fill kit for a portable spray system according to selected embodiments of the current disclosure.

FIG. 12 is a front view of a fill kit for a portable spray system according to selected embodiments of the current disclosure. The fill kit includes a filling system 87 and a pressure adapter 85. The filling system has a main body 86 into which a fluid, such as water, is supplied. The fluid is inserted into the main body 86 through an opening 88 at the top. A fill line 82 is provided within a window 91 in the main body 86. The window 91 is made of a clear material, such as plastic, such that the user can see how much fluid is in the main body 86. The fill line 8 indicates how much water should be filled into the portable spray system such that the portable spray system is not overfilled. Once the appropriate volume of fluid is filled within the main body 86, the opening 88 is closed using closure 89. At the bottom of the main body 86 is a hose 81, which provides fluid access to the main body 86. A strap 90 is secured to two ends of the main body 86 to provide a convenient means for carrying the fill kit. The pressure adapter 85 has a quick release fitting 84 that mates with the quick release port of the hose of the portable spray system.

To fill the portable spray system, any cover over the second port is removed. The hose of the fill system is inserted through the second port and into the pressure container of the portable spray system. The diameter of the hose of the fill system is smaller than the diameter of the opening of the second port. As water flows from the main body of the fill system, through the hose, and into the pressure container, air is displaced from the pressure container through the second port around the outside of the hose.

Figure 13:
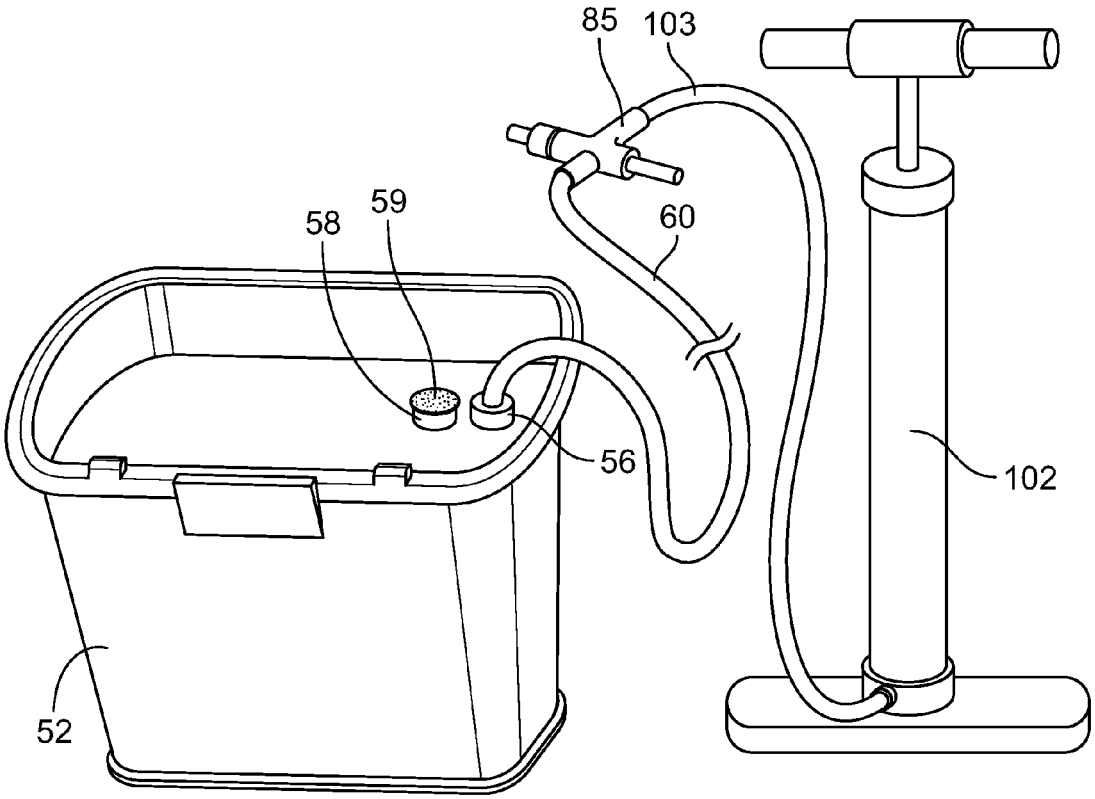
FIG. 13 is a perspective view of a portable spray system connected to a pump according to selected embodiments of the current disclosure.

FIG. 13 is a perspective view of a portable spray system connected to a pump according to selected embodiments of the current disclosure. The first port 56 of the portable spray system has a hose 60 connected thereto. At the end of the hose 60, the sprayer (not shown) has been removed. In its place, a pressure adapter 85 is attached to the hose 60. The pump 102 is connected to the pressure adapter 85 via pump hose 103. A port cover 59 seals second port 58, such that as pressure builds within the pressure container, fluid is not allowed to escape through the second port 58.

To pressurize the portable spray system, the second port 58 is sealed, either with a port cover 59, the heating probe 72 of the portable heater, or by some other seal or accessory. The pressure adapter 85 is secured to the hose 60 using a quick release fitting, and then a pump 102 is secured to the pressure adapter. The valve at the end of the hose 60 is opened to allow fluid to flow therethrough, and the pump is used to pump air into the pressure container of the portable spray system to increase the pressure therein. Once a sufficient pressure has been reached, the valve at the end of the hose is closed, thereby sealing the pressurized fluid within the pressure container. The portable spray system may subsequently be used just as if it was pressurized in some other manner, such as by the method of filling using a residential water source discussed above.

Indeed, it will be apparent to one of skill in the art how alternative functional configurations can be implemented to implement the desired features of the present invention. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

That which is claimed:

1. A spray system comprising a housing;

a pressure container, where the pressure container is encased within the housing, where the pressure container has a top and a bottom;

a first port, where the first port provides access to the bottom of the pressure container;

a hose, where a first end of the hose is connected to the first port;

a valve, where the valve is connected to a second end of the hose;

a quick release port, where the quick release port is connected to the valve;

a second port, where the second port provides access to the top of the pressure container; and a heater comprising a heating probe wherein the heating prove extends through the second port.

2. The spray system of claim 1, wherein the first port extends towards, but not all the way to, the bottom of the pressure container.

3. The spray system of claim 1, further comprising a sprayer; where the sprayer is releasably connected to the quick release port.

4. The spray system of claim 1, wherein the second port comprises threading.

5. The spray system of claim 4, wherein the heater further comprises a base unit and a cable, wherein the heating probe is electrically connected to the base unit via the cable, and where the heating prove comprises threading.

6. The spray system of claim 5, wherein the threading of the probe mates with the threading of the second port.

7. The spray system of claim 5, wherein the cable of the heater comprises a plug, where the plug is releasably connected to the heating probe, whereby the heating probe is detachable from the base unit and cable.

8. The spray system of claim 5, wherein the base unit comprises a battery.

9. The spray system of claim 5, wherein the base unit comprises a switch, whereby activating the switch activates the heater.

10. The spray system of claim 1, further comprising a fill kit, where the fill kit comprises a main body and a hose, where the hose is connected to the main body, where the main body comprises a fill line, where the fill line indicates the maximum amount of fluid that should be dispensed into the main body of the fill kit such that the same volume of fluid dispensed into the pressure container will not overfill the pressure container.

11. The spray system of claim 1, wherein the main body further comprises an opening and a closure, where the closure seals the opening.

12. A method of dispensing a fluid comprising the steps of connecting a spray system to a fluid source, where the spray system comprises a housing; a pressure container, where the pressure container is encased within the housing, where the pressure container has a top and a bottom; a first port, where the first port provides access to the bottom of the pressure container, a hose, where a first end of the hose is connected to the first port; a valve where the valve is connected to a second end of the hose; a quick release port, where the quick release port is connected to the valve; a second port, where the second port provides access to the top of the pressure container, and inserting a heating probe through the second port;

filling the spray system with a fluid from the fluid source;

disconnecting the spray system from the fluid source;

transporting the system to a different location; and dispensing the fluid from the spray system.

13. The method of claim 12, wherein the step of connecting a spray system to a fluid source comprises connecting the quick release port to a residential water source.

14. The method of claim 12, wherein the step of dispensing the fluid from the spray system comprises connecting a spraying nozzle to the quick release port.

15. The method of claim 12, further comprising the steps of connecting a base unit to the heating prove via a cable; and activating a switch on the base unit to activate the heating probe thereby providing heat to the fluid held within the pressure container.

16. The method of claim 12, further comprising the steps of filling a fill kit, where the fill kit comprises a main body and a hose, where the hose is connected to the main body, where the main body comprises a fill line, where the fill line indicates the maximum amount of fluid that should be dispensed into main body of the fill kit such that the same volume of fluid dispensed into the pressure container will not overfill the pressure container, where the fill kit is filled to its fill line;

inserting the hose of the fill kit through the second port and allowing the fluid to flow therethrough.

17. The method of claim 16, further comprising steps of sealing the second port;

attaching a pressure adapter to the quick release port;

attaching a pump to the pressure adapter; and pumping air into the pressure container.

18. A method of dispensing heated water comprising the steps of filling a fill kit with water, where the fill kit comprises a main body and a fill hose, where the fill hose is connected to the main body, where the main body comprises a fill line, where the fill kit is filled to its fill line;

filling a spray system, where the spray system comprises a housing; a pressure container, where the pressure container is encased within the housing, where the pressure container has a top and a bottom; a first port, where the first port provides access to the bottom of the pressure container; a hose, where a first end of the hose is connected to the first port; a valve, where the valve is connected to a second end of the hose; a quick release port, where the quick release port is connected to the valve; and a second port, where the second port provides access to the top of the pressure container, where the spray system is filled by inserting the fill hose of the fill kit through the second port and allowing the fluid to flow therethrough;

inserting a heating probe through the second port, where the heating probe seals the second port;

attaching a pressure adapter to the quick release port;

attaching a pump to the pressure adapter;

pumping air into the pressure container;

closing the valve;

providing power to the heating probe, whereby heat is produced by the heating probe to heat up the water within the pressure container;

connecting a spraying nozzle to the quick release port;

opening the valve; and dispensing water through the spraying nozzle.

19. The method of claim 18, wherein the step of providing power to the heating probe comprises connecting a base unit to the heating probe and activating a switch on the base unit.

20. The method of claim 18, wherein the main body of the fill kit further comprises an opening and a closure, where the closure seals the opening.

* * * * *